US011607708B2

(12) United States Patent
Murphy

(10) Patent No.: US 11,607,708 B2
(45) Date of Patent: Mar. 21, 2023

(54) SCREENING APPARATUS WITH IMPROVED SCREEN MEDIA

(71) Applicant: Terex GB Limited, County Tyrone (GB)

(72) Inventor: Glenn Murphy, County Armagh (GB)

(73) Assignee: Terex GB Limited, Dungannon (GB)

( * ) Notice: Subject to any disclaimer, the term of this patent is extended or adjusted under 35 U.S.C. 154(b) by 209 days.

(21) Appl. No.: 16/386,634

(22) Filed: Apr. 17, 2019

(65) Prior Publication Data

US 2019/0321855 A1 Oct. 24, 2019

(30) Foreign Application Priority Data

Apr. 20, 2018 (GB) ..... 1806489

(51) Int. Cl.

| | |
|---|---|
| ***B07B 1/12*** | (2006.01) |
| ***B07B 1/04*** | (2006.01) |
| ***B07B 1/42*** | (2006.01) |
| *B07B 1/46* | (2006.01) |

(52) U.S. Cl.

CPC ..... *B07B 1/04* (2013.01); *B07B 1/12* (2013.01); *B07B 1/42* (2013.01); *B07B 1/4609* (2013.01); *B07B 2201/02* (2013.01); *B07B 2230/04* (2013.01)

(58) Field of Classification Search

CPC .. B07B 1/04; B07B 1/12; B07B 1/282; B07B 1/42; B07B 1/4609; B07B 13/10; B07B 2201/02; B07B 2230/04

USPC ..... 209/393, 395, 675, 394

See application file for complete search history.

(56) References Cited

U.S. PATENT DOCUMENTS 760,590 A * 5/1904 Vodra ..... B07B 1/12 209/393
1,187,238 A * 6/1916 Beaumont ..... B07B 1/48 209/393
1,491,802 A * 4/1924 Irwin ..... B07B 13/00 209/679

(Continued)

FOREIGN PATENT DOCUMENTS

CN 2696729 Y 5/2005
CN 203030518 U 7/2013

(Continued)

OTHER PUBLICATIONS

European Search Repod dated Oct. 3, 2019, for corresponding European Application No. EP19169908 filed on Apr. 17, 2019; consisting of 2-pages.

(Continued)

*Primary Examiner* — Joseph C Rodriguez
(74) *Attorney, Agent, or Firm* — Christopher & Weisberg, P.A.

(57) ABSTRACT

A screening apparatus comprising a body, a drive system for imparting vibrations to the body, and screen media that is coupled to the body by a resilient coupling mechanism that allows oscillatory movement of the screen media with respect to the body. In response to vibration of the body, the resilient coupling mechanism causes the screen media to oscillate in a manner that is amplified with respect to the vibration of the body. The amplification may depend on the frequency of the vibrations of the body and/or on the mass of any material gathered on the screen media.

19 Claims, 7 Drawing Sheets

(56) References Cited

U.S. PATENT DOCUMENTS 3,241,671 A * 3/1966 Brauchla ..... B07B 1/12 209/243
3,261,108 A * 7/1966 Rossi ..... B07B 1/12 34/164
3,971,716 A * 7/1976 Foreman ..... B07B 1/16 209/396
4,361,240 A * 11/1982 Davis ..... B07B 1/4636 209/674
4,956,078 A * 9/1990 Magerowski ..... B07B 1/12 209/243
5,219,078 A 6/1993 Hadden
5,322,170 A * 6/1994 Hadden ..... B07B 1/005 209/314
5,769,240 A 6/1998 Middour et al.
5,816,412 A * 10/1998 Bokor ..... B07B 1/4645 209/326
5,901,857 A * 5/1999 Schurman ..... B07B 1/12 209/674
6,041,943 A * 3/2000 Gifford ..... E02F 7/06 209/394
6,116,428 A * 9/2000 Loshe ..... B07B 1/12 209/319
7,011,217 B2 * 3/2006 Hanisch ..... B07B 1/12 209/319
7,383,957 B2 * 6/2008 Cox ..... B07B 1/12 209/395
8,708,154 B1 * 4/2014 Holmberg ..... B07B 1/145 209/394
9,993,844 B2 * 6/2018 Jenkins ..... B07B 1/12
10,472,800 B2 * 11/2019 McCabe ..... E02F 5/226
11,000,881 B2 * 5/2021 White ..... B30B 15/30
2004/0074815 A1 4/2004 Hanisch et al.
2008/0110807 A1 * 5/2008 Goguen ..... B07B 1/12 209/394
2017/0282216 A1 * 10/2017 Timmerman ..... B07B 1/48

FOREIGN PATENT DOCUMENTS

CN 206935744 U 1/2018
CN 207136185 U 3/2018
CN 207154100 U 3/2018
DE 202013100941 U1 4/2013
EP 0768123 A1 4/1997
GB 2087756 A 6/1982
UA 59194 C2 8/2003
WO 9409089 A1 4/1994

OTHER PUBLICATIONS

IPO Search Report dated Oct. 23, 2018, for corresponding Application No. GB1806489 9; Filing Date: Apr. 20, 2018 consisting of 1-page.
UK Examination Report under Section 18(3), dated Sep. 29, 2020, for corresponding Application No. GB1806489.9; consisting of 1-page.

* cited by examiner

SCREENING APPARATUS WITH IMPROVED SCREEN MEDIA

CROSS-REFERENCE TO RELATED APPLICATION

This application is related to and claims priority to Great Britain Application Serial No. 1806489.9, filed Apr. 20, 2018, entitled SCREENING APPARATUS WITH IMPROVED SCREEN MEDIA, the entirety of which is incorporated herein by reference.

FIELD

The present technology is generally related to screening apparatus and to screen media for use with screening apparatus.

BACKGROUND

Mechanical screening, which is usually just referred to as screening, involves separating particulate material, such as rocks or sand, multiple grades by particle size. Screening is used in a variety of industries including mining, quarrying, mineral processing, agriculture and recycling.

A conventional screening apparatus comprises a body that carries one or more decks of screen media. A drive system is provided for moving the body and decks such that it vibrates. The screen media is rigidly fixed to the body and so vibrates with the body. Therefore the amplitude and frequency of the vibration of the screen media is determined by the motion of the entire screening apparatus.

For some applications, for example when the material to be separated is sticky, it can be desirable to cause the screen media to vibrate with relatively high acceleration. High accelerations are more likely to prevent the material from sticking to the screen media and so to maintain an effective screening interface. However, vibrating the entire screening apparatus at high accelerations requires a relatively large drive system and significant structural reinforcement, which in turn increases the cost of manufacture and operation.

Furthermore, it is common for a screening apparatus to have more than one type of screen media (for example different decks may have different screen media) and vibrating the entire screen apparatus at high accelerations may be unnecessary or undesirable for all types of screen media that may be present.

It would be desirable therefore to provide a screening apparatus with improved screen media.

SUMMARY

The techniques of this disclosure generally relate to a screening apparatus comprising a body, a drive system coupled to the body for imparting vibrations to the body, and screen media, wherein said screen media is coupled to the body by a resilient coupling mechanism that allows oscillatory movement of said screen media with respect to said body.

Preferably, said screen media is provided in at least one screening module, said at least one screening module being coupled to the body and including a respective resilient coupling mechanism that allows oscillatory movement of the respective screen media with respect to said body.

In preferred embodiments, said resilient coupling mechanism has a spring axis, said oscillatory movement being in a direction perpendicular with said spring axis. Typically, said oscillatory movement is in a direction perpendicular with a transverse axis and a longitudinal axis of the body.

Advantageously, the screen media and the respective resilient coupling mechanism are configured to resonate with respect to the body at a selected resonant frequency.

The screen media may be coupled to a base, the base being coupled to the body by said resilient coupling mechanism. The base may be part of said screening module.

The screen media may be cantilevered from the base, typically projecting from said base and having a free end distal said base. The screen media may be self-supporting and is optionally resilient. In preferred embodiments, the screen media comprises a plurality of parallel bars, or a mesh, or a screen cloth or other screen.

Typically, said resilient coupling mechanism comprises at least one spring coupled between said body and said screen media. Said at least one spring may comprise at least one strip of resilient material. Typically, said at least one spring defines said spring axis, said spring axis preferably being in a direction that is transverse of said body.

In preferred embodiments, said resilient coupling mechanism comprises first and second parts, the first part coupling a first side of the screen media to the body, the second part coupling a second side of the screen media to the body. Each of said first and second coupling parts may comprise a resilient coupling element, preferably comprising a strip of resilient material. The resilient coupling element of the first and second coupling parts may project from opposite sides of said body and are aligned with one another. Each coupling part typically includes an adjustable connector for coupling the resilient element to the screen media. The connector may be movable along the resilient element in order to adjust the location at which the resilient element is coupled to screen media. Preferably, the connector comprises a clamp having first and second parts located on opposite sides of the resilient element.

Conveniently, said resilient coupling mechanism is coupled to said base, preferably to an underside of said base.

Preferably, said resilient coupling mechanism includes at least one damping adjustment mechanism for controlling damping of said oscillatory movement of the screen media with respect to the body.

Said at least one damping adjustment mechanism may comprise at least one block located between said at least one spring and said screen media, said at least one block preferably being movable along the spring axis.

Preferably, said resilient coupling mechanism is configured to amplify the oscillation of said screen media with respect to said vibrations imparted to said body by said drive system.

Advantageously, in response to vibration of said body by said drive system, said resilient coupling mechanism causes said screen media to oscillate, wherein said oscillation of said screen media may be amplified with respect to said vibrations imparted to said body by said drive system, and wherein the amplification may depend on the frequency of the vibration of said body and/or on the mass of material on said screen media.

Advantageously, the apparatus includes means for adjusting the resilience of said resilient coupling mechanism.

Preferably, said resilient coupling mechanism is tuned to cause said selected resonant frequency to be higher than an operating frequency of said oscillatory movement of said screen media.

A second aspect of the invention provides a screen module comprising screen media and a resilient coupling mechanism for coupling said screen module to a body of a screening apparatus, the resilient coupling mechanism being configured to allow oscillatory movement of said screen media with respect to said body.

Further advantageous aspects of the invention will be apparent upon review of the following description of a specific embodiment and with reference to the accompanying drawings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
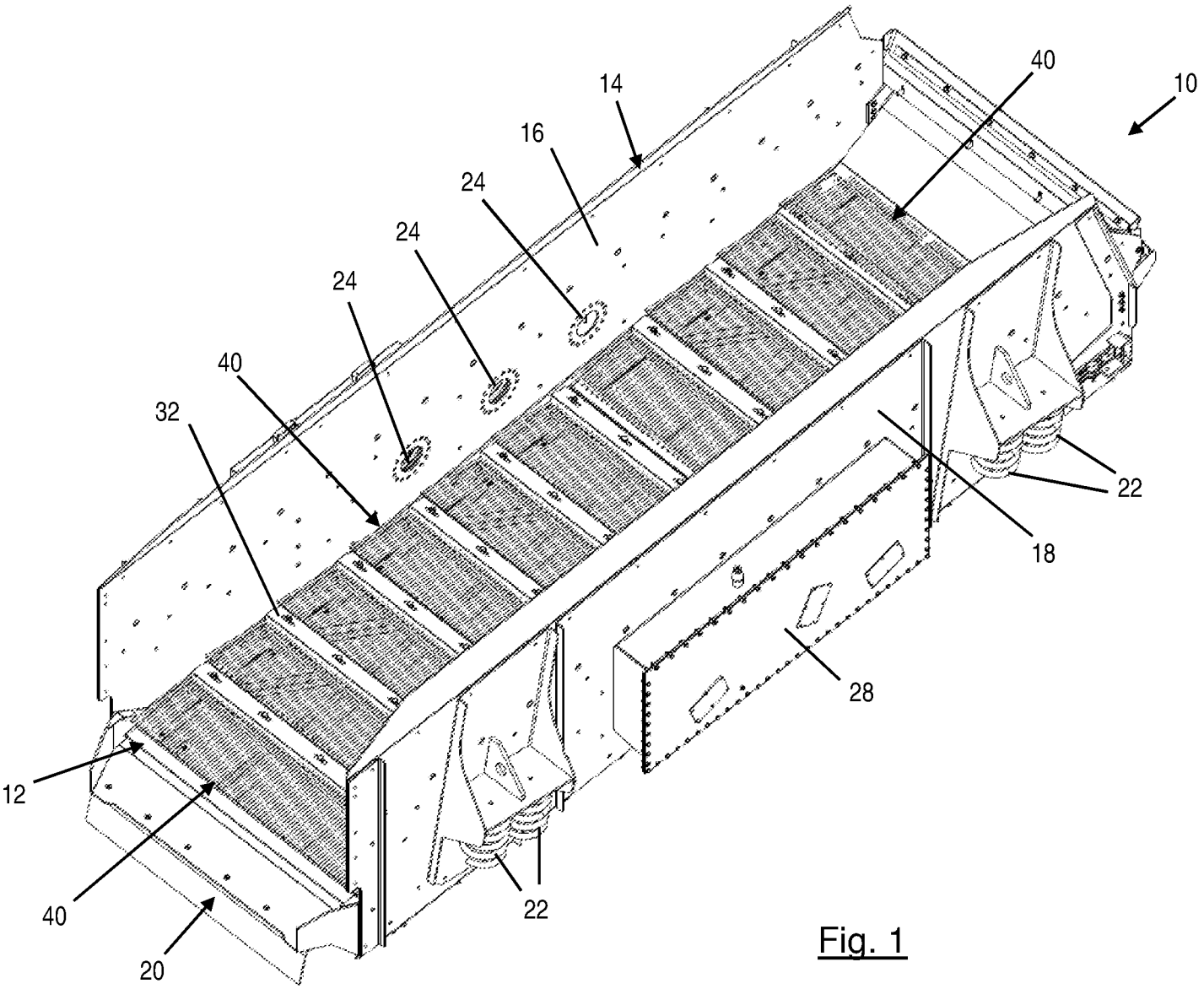
FIG. 1 is a perspective view of a screening apparatus embodying one aspect of the invention, including screen media embodying another aspect of the invention.

Referring now to FIG. 1 of the drawings there is shown, generally indicated as 10, a screening apparatus embodying one aspect of the invention. The screening apparatus 10 is of a type suitable for use in separating particulate material, e.g. sand, stones, rocks or other aggregate material or recyclable material, according to size.

The screening apparatus 10 comprises one or more screening decks carried by a supporting body 14. In the drawings, only one screening deck 12 is shown. In alternative embodiments there may be more than one screening deck, in which case the decks 12 are typically stacked within the body 14. For example, the body 14 shown in FIG. 1 is shaped and dimensioned to accommodate a second screening deck (not shown) above the deck 12. The, or each, screening deck 12 is mounted between opposing side walls 16, 18 of the body 14. Any suitable fixing, mounting or coupling devices (not shown) may be used for this purpose. Usually, the decks 12 are removable from the body 14, for example for the purpose of replacement or repair. In typical embodiments, the body 14 is box-like in form, although it may comprise any supporting structure that is shaped and dimensioned to carry one or more screening decks 12. Typically at least one end 20 of the body 14 is open to allow screened material to be removed from the screening apparatus 10, for example by a conveyor (not shown).

Figure 6:
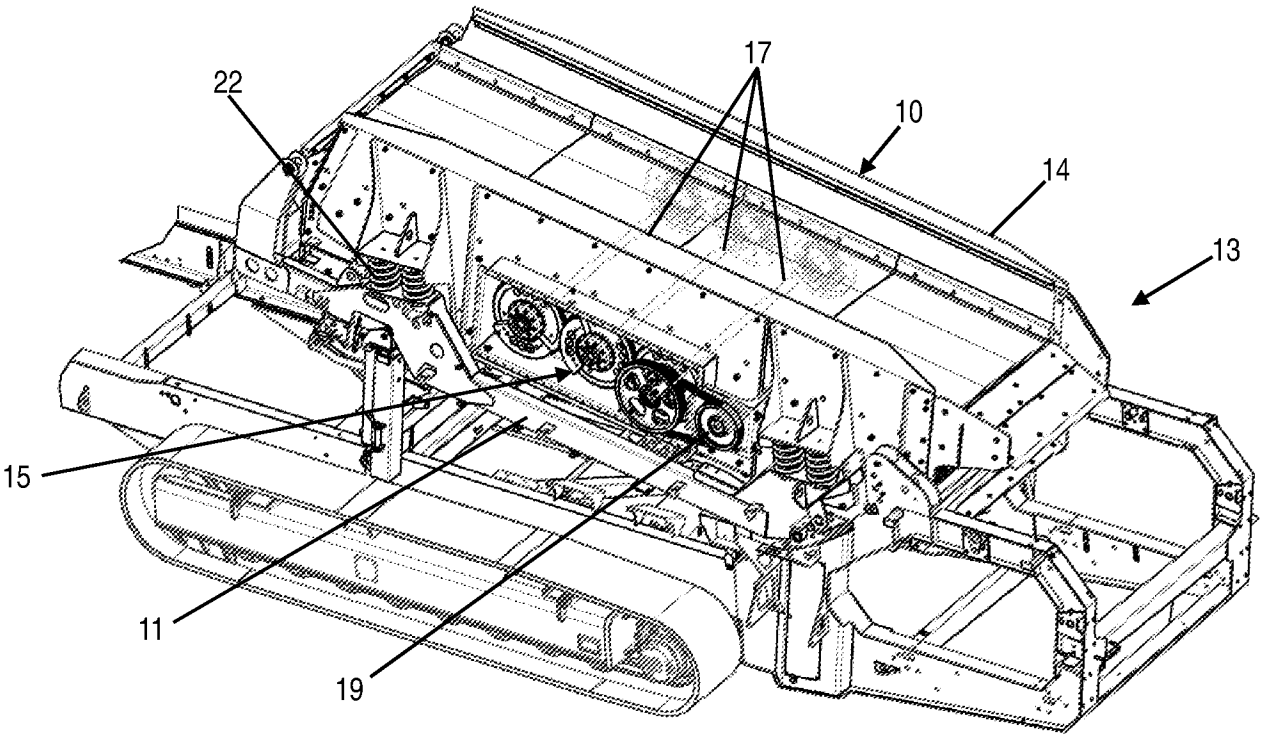
FIG. 6 shows the screening apparatus of FIG. 1 incorporated into a material processing apparatus.

In use, the screening apparatus 10 is mounted on a base 11, which may for example be the chassis, or be mounted on the chassis, of a vehicle (see FIG. 6) such as a material processing apparatus 13. The screening apparatus 10 is mounted on the base 11 by a suspension system which, in the illustrated embodiment, comprises springs 22, to allow relative movement between the screening apparatus 10 and the base 11.

The screening apparatus 10 also includes a drive system 15 for causing the screening apparatus 10 to vibrate. The drive system 15 may take a variety of conventional forms and may be configured to cause the screening apparatus 10 to vibrate in one or more ways (e.g. linear vibrations or orbital (e.g. circular or elliptical) vibrations) and at one or more velocities and/or accelerations. For example, the drive system 15 may comprise one or more eccentrically weighted shaft 17 and one or more motor 19 coupled to the, or each, shaft 17 for rotating the, or each, shaft 17. Rotation of the eccentrically weighted shaft(s) causes the screening apparatus 10 to move (vibrate) with respect to the base 11. In cases where there is more than one shaft 17, the respective rotational phase and rotational direction of the shafts determine the type of vibrationary movement that is caused. Typically, the, or each, shaft 17 extends transversely across the body 14, between the side walls 16, 18. In the illustrated embodiment, the body 14 is configured to accommodate up to three shafts, as can be seen from the three bearing apertures 24 provided in the side wall 16 (corresponding aligned apertures (not visible) are provided in the other side wall 18). A housing 28 is provided for housing components of the drive system, as required, for example shaft bearings, flywheels, masses, and/or couplings. In alternative embodiments, other drive systems may be used to vibrate the screening apparatus 10, for example comprising one or more crank mechanism or one or more linear electromagnetic agitator.

Figure 2:
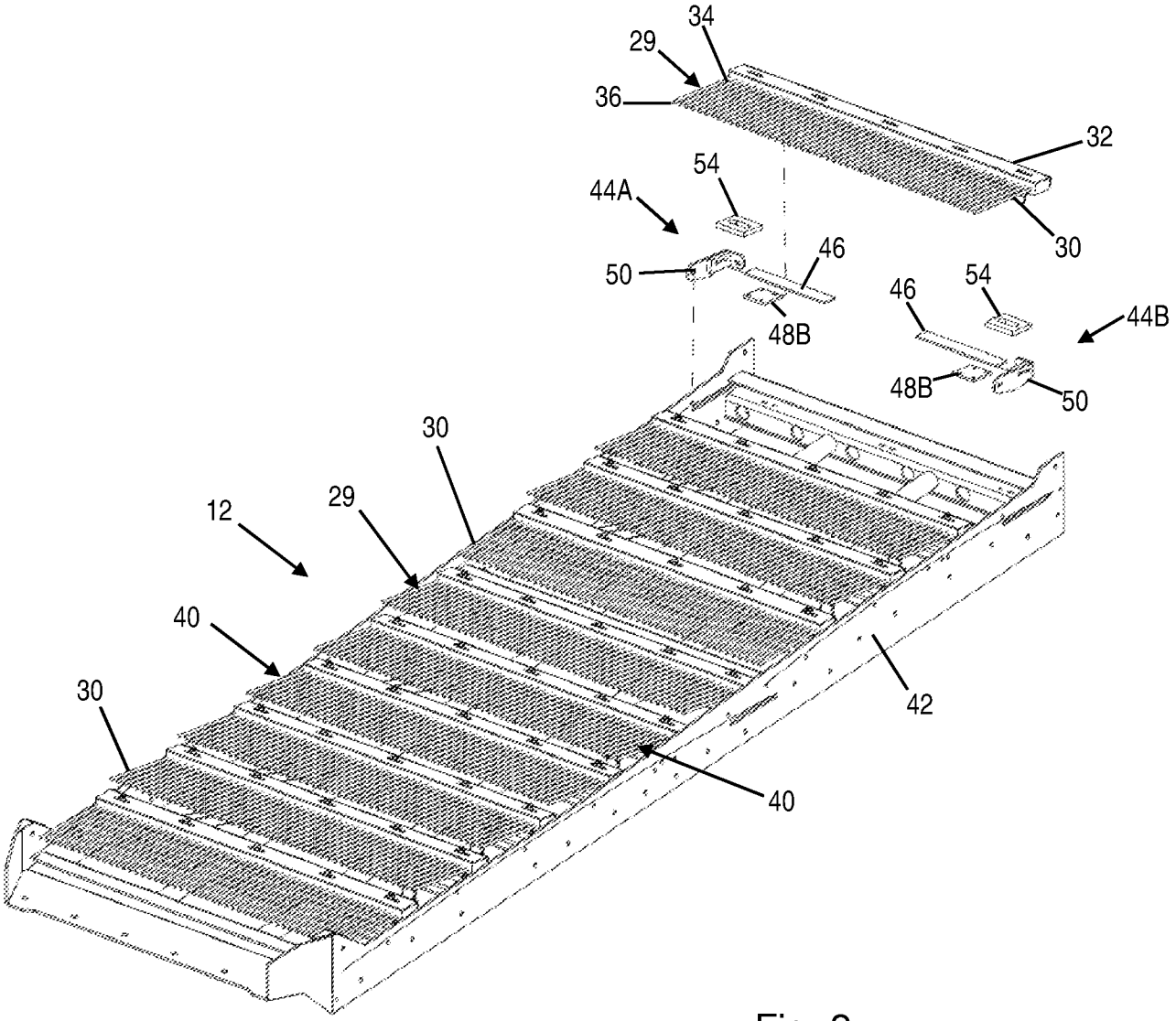
FIG. 2 is a perspective view of a screening deck suitable for use in the screening apparatus and including screen media in the form of a plurality of screen media modules.

Referring now to FIG. 2, the preferred screening deck 12 is shown in more detail. The deck 12 comprises means for screening material, the screening means commonly being referred to as screen media, or a screen. Screen media may take a variety of different forms, for example comprising parallel bars, a grid, a mesh or a screen cloth. In preferred embodiments, the screen media 29 comprises a plurality of parallel, spaced apart bars 30, preferably arranged to be substantially coplanar with each other (in a rest state at least). The bars 30 project from a common base 32. In particular one end 34 of each bar 30 is fixed to the base 32, the other end 36 being free. As such the bars 30 may be said to be cantilevered from the base 32, and the bars 30 may be described as fingers projecting from the base 32. The base 32 may comprise a bar that runs perpendicularly to the bars 30.

The bars 30 may be fixed to the base 32 in any convenient manner, for example by welding or embedding. The bars 30 may be capable of movement, e.g. a flexing movement, with respect to the base 32. The bars 30 are preferably formed from a flexible resilient material, for example metal, plastics, rubber or a composite material. The base 32 may be formed from any suitable material, for example metal, plastics, rubber or a composite material.

In alternative embodiments (not illustrated), the screen media may take other forms, for example a grid, a mesh or a screen cloth or other screen. The preferred arrangement is such that the screen media projects from the base in a cantilevered manner, or otherwise such that it has a free end distal the base 32. The screen media, or screen, is typically self-supporting and may be resilient. It is noted that, in cases where the screening apparatus 10 has more than one screening deck, the decks may have different types of screen media.

In preferred embodiments, the screen media 29 is provided on the deck 12 as at least one but typically a plurality of screening modules 40. In the preferred embodiment, each module 40 comprises a respective array of bars 30 (or other screen media as applicable) projecting from a respective base 32. The modules 40 are arranged in an array to collectively provide the deck 12 with a screening surface. Typically, the modules 40 are arranged end-to-end to provide a substantially continuous screening surface that is preferably substantially planar.

In typical embodiments, the deck 12 comprises a frame 42 on which the screen media 29, in particular the modules 40, are mounted (usually removably mounted). The frame 42 is mountable in the body 14 of the screening apparatus 10, usually between the walls 16, 18. In alternative embodiments, the screen media 29, whether in modular form or not, may be mounted on the body 14 to provide the screening deck 12 without the frame 42.

The screen media 29 is resiliently coupled to the body 14 of the screening apparatus 10. In particular, the screen media 29 is resiliently coupled to the body 14 to facilitate resilient movement, preferably oscillatory movement, of the screen media 29 with respect to the body 14 in a direction that is perpendicular to the transverse and longitudinal axes of the body 14. In preferred embodiments, the screening module 40 is coupled to the body 14 to allow the resilient movement of the screen media 29 with respect to the body 14. It is preferred that the screen media 29, or screening module 40 as applicable, is coupled to the body 14 at the base 32.

Figure 3:
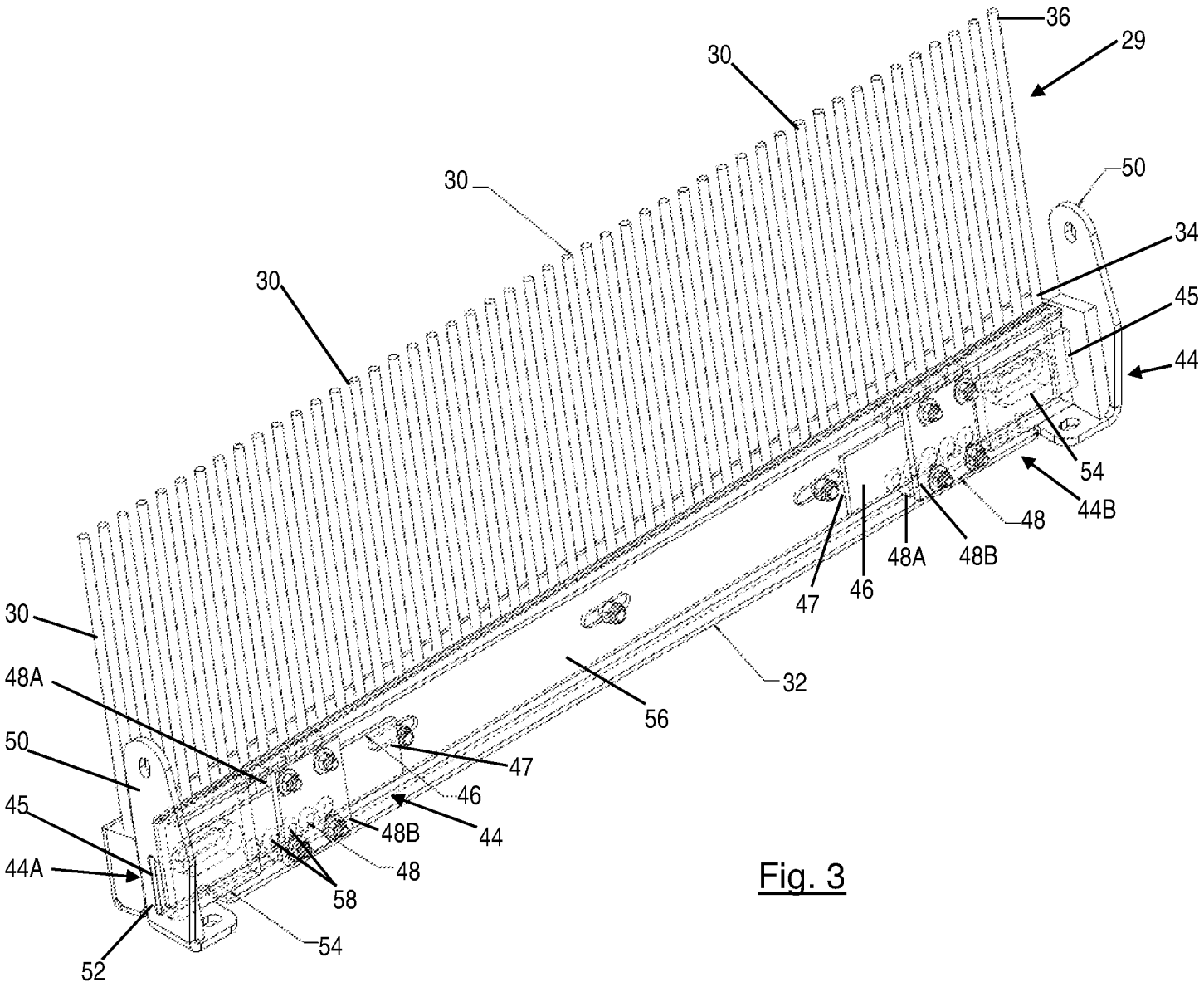
FIG. 3 is a perspective view of a screen media module suitable for use in the screening deck of FIG. 2.

Referring now in particular to FIGS. 2 and 3, there is described a preferred resilient coupling mechanism 44, which in preferred embodiments may be considered to be part of the screening module 40, for coupling the screen media 29 to the body 14. It is noted that, in the illustrated embodiment, the resilient coupling mechanism 44 couples the screen media 29 to the frame 42, and the frame 42 is mounted, usually rigidly, on the body 14, i.e. the coupling mechanism 44 couples the screen media 29 indirectly to the body 14. In alternative embodiments (not illustrated), for example where there is no frame 42, the coupling mechanism 44 may couple the screen media 29 directly to the body 14.

In preferred embodiments, the coupling mechanism 44 comprises first and second parts 44A, 44B, which are conveniently the same as each other, the first part 44A being used to couple one side of the screen media 29 to the body 14, the second part 44B being used to couple the other side of the screen media 29 to the body 14. As indicated above, the coupling may be direct or indirect depending on whether or not the frame 42 is present. The coupling parts 44A, 44B couple the respective sides of the screen media 29 to a respective side wall 16, 18 of the body 14.

Figure 4:
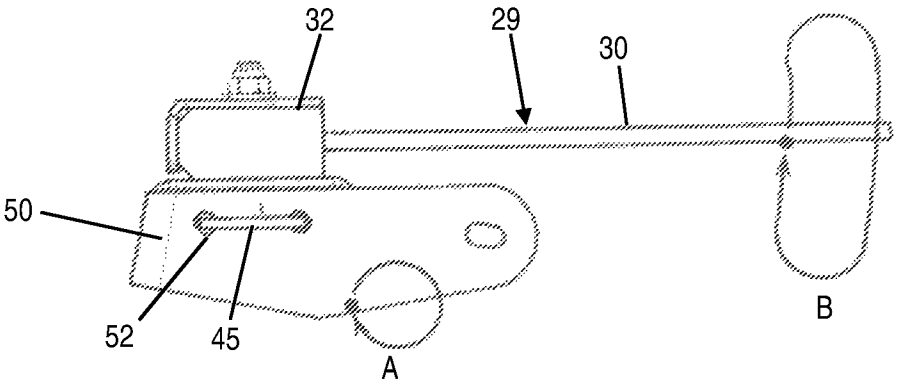
FIG. 4 is a side view of the screen media module of FIG. 3.
Figure 7A:
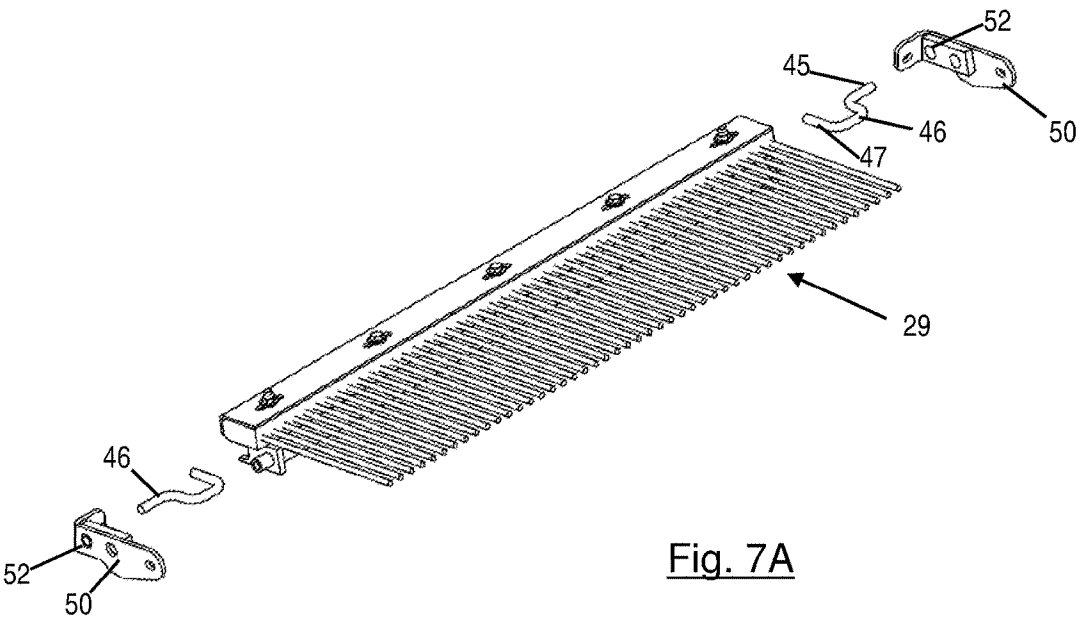
FIG. 7A is a perspective exploded view of the screen media module with an alternative resilient element.
Figure 7B:
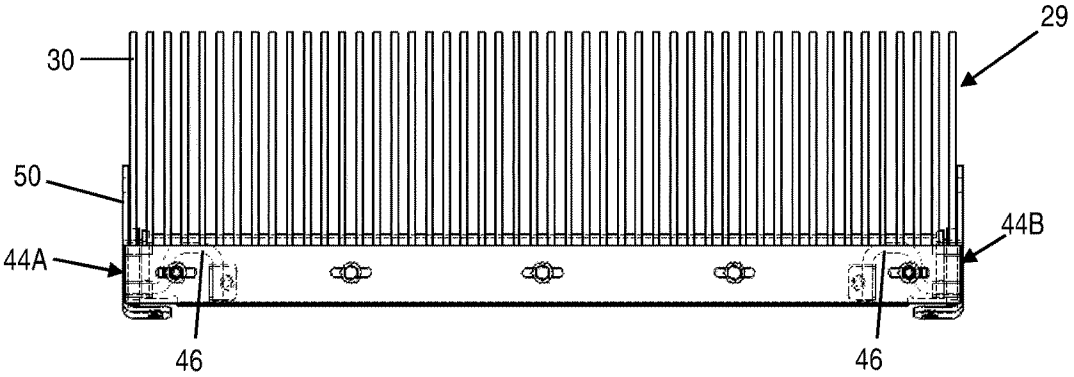
FIG. 7B is a plan view of the screen media module of FIG. 7B.

Each coupling part 44A, 44B comprises a resilient coupling element 46. The resilient coupling element 46 may comprise one or more spring. For example, as shown in the embodiments of FIGS. 2 to 4, the resilient coupling element may comprise a flat spring or leaf spring, e.g. a single leaf spring. Optionally, the resilient coupling element 46 comprises a strip of resilient material, for example of metal (e.g. spring steel), plastics, rubber or a composite material. The strip may be rectangular and, in its rest state, flat. Alternatively, and as illustrated in FIGS. 7A and 7B, the resilient coupling element 46 may comprise a torsion spring, for example in the form of a torsion bar or wire.

The resilient element 46 typically has a first end 45 which, in use, is coupled (directly or indirectly) to the body 14, and a second end 47, which may be a free end or may be coupled to the body 14 by any convenient means, e.g. a socket and/or bush. The axial direction between the first and second ends 45, 47 may be referred to as the spring axis, and is the axis along or about which the resilient element 46 can flex resiliently to provide a spring effect.

Optionally, each coupling part 44A, 44B includes an adjustable connector 48 for coupling the resilient element 46 to the screen media 29. The connector 48 is movable along the longitudinal, or spring, axis of the resilient element 46 in order to adjust the location (between ends 45, 47) at which the resilient element 46 is coupled to the screen media 29. It will be understood that the distance between the first end 45 and the location of the connector 48 determines the spring effect provided by the coupling parts 44A, 44B, i.e. by adjusting the effective stiffness, or resilience, of the coupling 44. In alternative embodiments, any other mechanism for adjusting the resilience of the coupling may be provided.

In the embodiment of FIGS. 2 to 4, the connector 48 comprises a clamp having first and second parts 48A, 48B, located on opposite sides of the resilient element 46. The clamp parts 48A, 48B may take the form of a block or plate, and may be made from any suitable material, for example metal, plastics, rubber or a composite material.

The first end 45 of the resilient element 46 may coupled to the body 14 such that the resilient element 46 projects away from the body 14, preferably along the transverse axis of the body 14, i.e. perpendicular to the respective side wall 16, 18. The coupling parts 44A, 44B are located on their respective side walls 16, 18 such that they are aligned with one another and such that the respective resilient elements 46 lie substantially on a common transverse axis. The resilient elements 46 may be said to be cantilevered with respect to the respective side walls 16, 18.

Preferably, each coupling part 44A 44B includes a mounting bracket 50 for mounting the resilient element 46 to the frame 42, or the wall 16, 18 as applicable. In the illustrated embodiment, the mounting bracket 50 has a socket 52 for receiving the first end 45 of the resilient element 46. Any other convenient coupling means may be provided for coupling the resilient element 46 to the body 14.

In preferred embodiment, the mounting brackets 50 fix the screen module 40 to the frame 42 (or wall 16, 18), while the resilient coupling parts 44A, 44B facilitate the desired resilient movement of the screen media 29 with respect to the body 14.

Conveniently, the coupling parts 44A, 44B are coupled to the base 32, preferably to the underside of the base 32. In the embodiment of FIGS. 2 to 4, the resilient element 46 is coupled to the underside of the base 32 by the connector 48. Optionally, each coupling part 44A, 44B may include a damping element 54, for example in the form of a block of any suitable material, e.g. plastics or rubber. The damping element 54 may be located between the resilient element 46 and the base 32, between the first end 45 of the resilient element and the connector 48. The damping element 54 may be used to adjust the damping of the spring effect providing by the coupling mechanism 44. For example, the size and/or location and/or material of the damping element 54 may be altered to adjust the damping.

In the illustrated embodiment, a mounting plate 56 is provided to facilitate connection of the connector 48 to the base 32. The mounting plate 56 may include one or more apertures 58 for receiving screws, bolts or other fixings for connecting the connector 48 to the mounting plate 56, preferably in any one of a plurality of locations in the longitudinal direction, and so to couple the resilient element 46 to the mounting plate 56 at the desired location along its spring axis. The mounting plate 56 may be fixed to the base 32, preferably to the underside of the base 32, in any convenient manner.

The resilient elements 46, acting as springs, allow the screen media 29, to oscillate with respect to the body 14 along an axis that is perpendicular to the spring axis (and also perpendicular to the longitudinal axis of the body 14). In the illustrated embodiment, the mounting brackets 50 are fixed with respect to the body 14 and the assembly of the screen media 29, base 32 and mounting plate 56 (when present) are capable of the desired resilient movement with respect to the body 14, as facilitated by the resilient coupling 44.

With reference to FIG. 4, when the drive system operates to vibrate the screening apparatus 10, a corresponding vibration is imparted to the screen media 29/screening module 40 as indicated by arrow A. In the illustrated embodiment it is assumed that the drive system vibration is circular, although in alternative embodiments other types of vibration may be effected, as indicated above. The spring effect provided by the resilient coupling mechanism 44 allows the corresponding oscillatory movement, or vibration, of the screen media 29 to be amplified in comparison with the oscillatory movement of the body 14. This is illustrated by arrow B in FIG. 4, from which it can be seen that the amplitude of the vibrations, or oscillations, the bars 30 is greater than the amplitude of the vibrations of the body 14, which are indicated by arrow A. The acceleration of the vibrations of the screen media 29 is also amplified in comparison with the acceleration of the vibration of the body 14.

In the illustrated embodiment, the coupling mechanism 44 allows amplification of the vibration of the assembly of the screen media 29, base 32 and mounting plate 56 (when present) in comparison with the vibration imparted to the body 14 by the drive system 15. In this example, the vibration caused by the drive system 15 is imparted to the screen media 29 via the frame 42 and mounting brackets 50, each of which is fixed with respect to the body 14. The extent of the amplification of the vibrations depends on the frequency response of the assembly comprising the coupling parts 44A, 44B and the screen media 29, and on the operating frequency of the screening apparatus 10 (i.e. the vibration frequency caused by the drive system 15).

In preferred embodiments, the assembly comprising the coupling parts 44A, 44B and the screen media 29 is configured to resonate (mechanically) at a resonant frequency at which the amplified vibrations of the screen media 29 are maximised. The resonant frequency, and the characteristics (in particular amplitude but optionally also the shape and/or acceleration) of the screen media 29 vibrations at the resonant frequency, are determined by a number of factors including the mass of the assembly, the stiffness/resilience of the elements 46, the level of damping applied and the shape and dimensions of the screen media 29. Therefore, by controlling any one or more of these factors, the frequency response of the screen media 29 (e.g. the resonant frequency and/or other vibration characteristic(s) such as amplitude and/or acceleration) can be selected and adjusted to suit the application. Controlling the frequency response of the screen media 29, may be performed using the adjustable connectors 48 and/or the damping elements 54. For example, the frequency at which the screen media 29 resonates may be selected by adjusting the stiffness of the, or each, spring element 46. Alternatively, or in addition, the resonant frequency may be selected by adjusting the mass of the assembly comprising the coupling parts 44A, 44B and the screen media 29. The amplitude of the vibrations may for example be selected by adjusting the damping elements 54. More generally, one or more characteristics of the vibrations of the assembly comprising the coupling parts 44A, 44B and the screen media 29 may be selected by adjusting the stiffness of the, or each, spring element 46, and/or by adjusting the mass of the assembly and/or by adjusting the damping elements 54.

Figure 5:
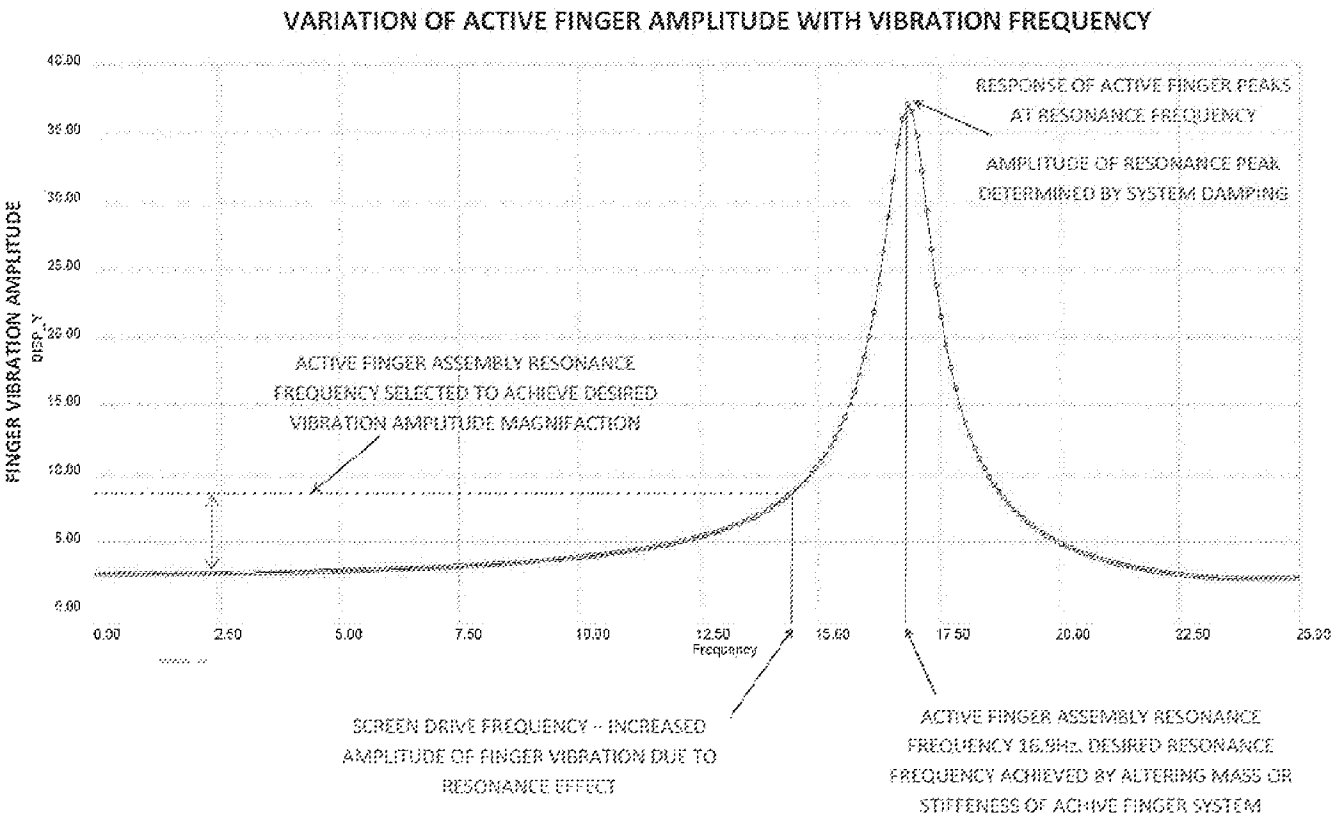
FIG. 5 is a graph illustrating a frequency response of the screen media module of FIG. 3.

FIG. 5 illustrates an exemplary frequency response of screen media assembly. In this example, the resonant frequency of the screen media 29 is assumed to be 16.9 Hz. At frequencies below and above the resonant frequency, the amplitude of the vibrations of the screen media 29 is relatively low and relatively constant. However, as the frequency approaches the resonant frequency, the amplitude increases, peaking at the resonant frequency itself. The acceleration of the vibrations also tends to increase (over the acceleration of the vibrations of the body 14 itself) as the frequency approaches and reaches the resonant frequency.

In use, an operator operates the drive system 15 to vibrate the body 14 at an operating frequency, which may be varied as required to suit the application. The resilient coupling mechanism 44 causes the screen media assembly to vibrate in an amplified manner depending on the frequency response of the screen media assembly. In order to cause amplified vibrations and acceleration of the screen media 29, the operator of the screening apparatus 10 may control the drive system 15 to vibrate the body 14 at an operating frequency that causes the screen media 29 to vibrate at a frequency close to the resonant frequency. It may be desirable not to operate the screen media 29 at the selected resonant frequency due to excessive induced stresses associated with peak vibration amplitudes, and so it may be desirable to choose an operating frequency that causes the screen media assembly to vibrate at an operating frequency lower than the selected resonant frequency. Alternatively, the screen media assembly may be adjusted, by any of the means described above, such that its selected resonant frequency is higher than the operating frequency of the screen media assembly caused by the desired operating frequency of the body 14. In either case, this provides an advantage that, should material begin to accumulate on the screen media 29, the increased mass of the screen media 29 and the accumulated material lowers the selected resonant frequency of the screen media 29 closer to its operating frequency, resulting in a temporary increase in screen media vibration amplitude. The resulting more aggressive vibrations tend to remove material adhered to the media 29, therefore maintaining an efficient screening interface.

Advantageously, the frequency response of the screen media 29 is tunable, for example to suit the operating frequency of the drive system 15. Tuning may be performed by adjusting the resilience of resilient coupling mechanism 44 and/or adjusting the damping. It is preferred that the screen media 29 and coupling assembly 44 is tuned to cause the selected resonant frequency of the screen media 29 to be higher than the operating frequency of the screen media 29 corresponding to the operating frequency of the drive system 15.

It is noted that any part of the screening apparatus 10, including any screening modules that do not have a resilient coupling with the body 14, do not exhibit the amplified vibrations and acceleration. Moreover, some screening modules may be tuned such that the respective screen media resonates at a different frequency than others. For example the screening module(s) on one deck may be tuned to resonate at a different frequency than the screening module (s) of another deck. Accordingly, the screening apparatus 10 may be configured so that at least one of its screening module(s) is operable with vibrations of a relatively high acceleration and amplitude without having to drive the entire screening apparatus with correspondingly high vibrations. Advantageously, the amplified vibrations are provided without the need for any powered drive means other than the drive system for the body itself.

The invention is not limited to the embodiment(s) described herein but can be amended or modified without departing from the scope of the present invention.

It should be understood that various aspects disclosed herein may be combined in different combinations than the combinations specifically presented in the description and accompanying drawings. It should also be understood that, depending on the example, certain acts or events of any of the processes or methods described herein may be performed in a different sequence, may be added, merged, or left out altogether (e.g., all described acts or events may not be necessary to carry out the techniques). In addition, while certain aspects of this disclosure are described as being performed by a single module or unit for purposes of clarity, it should be understood that the techniques of this disclosure may be performed by a combination of units or modules associated with, for example, a medical device.

In one or more examples, the described techniques may be implemented in hardware, software, firmware, or any combination thereof. If implemented in software, the functions may be stored as one or more instructions or code on a computer-readable medium and executed by a hardware-based processing unit. Computer-readable media may include non-transitory computer-readable media, which corresponds to a tangible medium such as data storage media (e.g., RAM, ROM, EEPROM, flash memory, or any other medium that can be used to store desired program code in the form of instructions or data structures and that can be accessed by a computer).

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor" as used herein may refer to any of the foregoing structure or any other physical structure suitable for implementation of the described techniques. Also, the techniques could be fully implemented in one or more circuits or logic elements.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A screening apparatus for screening material, the apparatus comprising:

a body;

a drive system coupled to the body for imparting vibrations to the body; and screen media, wherein said screen media is provided in at least one screening module, said at least one screening module comprising a base, said screen media projecting from the base and having a free end distal the base, and wherein the base is coupled to the body by a resilient coupling mechanism that allows oscillatory movement of the base and the screen media with respect to the body, wherein said resilient coupling mechanism comprises first and second parts, the first part coupling a first side of the screen media to the body, the second part coupling a second side of the screen media to the body, wherein each of said first and second coupling parts comprises a resilient coupling element, and wherein the resilient coupling element of the first and second coupling parts project from opposite sides of said body wherein at least one of said first and second coupling parts includes an adjustable connector for coupling the respective resilient coupling element to the screen media.

2. The screening apparatus of claim 1, wherein said resilient coupling mechanism has a spring axis, said oscillatory movement being in a direction perpendicular with said spring axis.

3. The screening apparatus of claim 1, wherein said oscillatory movement is in a direction perpendicular with a transverse axis and a longitudinal axis of the body.

4. The screening apparatus of claim 1, wherein said screen media is at least one from the group consisting of cantilevered from the base, and projects from said base and has a free end distal said base.

5. The screening apparatus of claim 1, wherein said screen media is self-supporting and resilient.

6. The screening apparatus of claim 1, wherein said screen media comprises a plurality of parallel bars.

7. The screening apparatus of claim 1, wherein said resilient coupling mechanism comprises at least one spring coupled between said body and said screen media, and wherein said at least one spring comprises at least one from the group consisting of the at least one strip of resilient material and a torsion spring.

8. The screening apparatus of claim 7, wherein said at least one spring defines said spring axis, said spring axis being in a direction that is transverse of said body.

9. The screening apparatus of claim 1, wherein said first and second resilient coupling elements are aligned with one another.

10. The screening apparatus of claim 9, wherein each adjustable connector is movable along the respective resilient coupling element in order to adjust the location at which the respective resilient coupling element is coupled to screen media, and wherein each adjustable connector comprises a clamp having first and second parts located on opposite sides of the resilient coupling element.

11. The screening apparatus of claim 1, wherein said resilient coupling mechanism is coupled to an underside of said base.

12. The screening apparatus of claim 1, wherein said resilient coupling mechanism comprises at least one spring coupled between said body and said screen media, said at least one spring defining a spring axis, and wherein said resilient coupling mechanism includes at least one damping adjustment mechanism for controlling damping of said oscillatory movement of the screen media with respect to the body, and wherein said at least one damping adjustment mechanism comprises at least one block located between said at least one spring and said screen media, said at least one block being movable along the spring axis.

13. The screening apparatus of claim 1, including means for adjusting the resilience of said resilient coupling mechanism.

14. The screening apparatus of claim 1, wherein said at least one screening module and the resilient coupling mechanism are configured to cause resonance of the oscillatory movement of the screen media at a selected frequency of said vibrations, and wherein said drive system is operable to impart said vibrations to the body at an operating frequency, and wherein said at least one screen module and said resilient coupling mechanism are configured to cause said selected frequency of said vibrations to be higher than said operating frequency.

15. The screening apparatus of claim 1, wherein said resilient coupling mechanism is configured to amplify the oscillation of said screen media with respect to said vibrations imparted to said body by said drive system.

16. The screening apparatus of claim 1, wherein said base extends transversely of said body and has first and second ends, said resilient coupling mechanism comprising first and second resilient coupling elements resiliently coupling said first and second ends, respectively, to said body.

17. The screening apparatus of claim 1, wherein a mass of said at least one screening module and a resilience of said resilient coupling mechanism is configured to cause said resonance of the oscillatory movement of the screen media at said selected frequency of said vibrations.

18. A screening apparatus comprising a body, a drive system coupled to the body for imparting vibrations to the body, and screen media, wherein said screen media is coupled to the body by a resilient coupling mechanism that allows oscillatory movement of said screen media with respect to said body, wherein said resilient coupling mechanism comprises first and second parts, the first part coupling a first side of the screen media to the body, the second part coupling a second side of the screen media to the body, wherein each of said first and second coupling parts comprises a resilient coupling element, and wherein the resilient coupling element of the first and second coupling parts project from opposite sides of said body wherein at least one of said first and second coupling parts includes an adjustable connector for coupling the respective resilient coupling element to the screen media, and wherein the adjustable connector is movable along the respective resilient coupling element in order to adjust the location at which the resilient coupling element is coupled to the screen media.

19. A screening apparatus comprising a body, a drive system coupled to the body for imparting vibrations to the body, and screen media, wherein said screen media is coupled to the body by a resilient coupling mechanism that allows oscillatory movement of said screen media with respect to said body, wherein said resilient coupling mechanism comprises first and second parts, the first part coupling a first side of the screen media to the body, the second part coupling a second side of the screen media to the body, wherein each of said first and second coupling parts comprises a resilient coupling element, and wherein the resilient coupling element of the first and second coupling parts project from opposite sides of said body wherein at least one of said first and second coupling parts includes means for adjusting the resilience of said resilient coupling mechanism.

* * * * *